US007190249B2

(12) United States Patent
Maekawa et al.

(10) Patent No.: US 7,190,249 B2
(45) Date of Patent: Mar. 13, 2007

(54) IGNITION COIL

(75) Inventors: Toshio Maekawa, Tokyo (JP); Shigemi Murata, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/913,522

(22) Filed: Aug. 9, 2004

(65) Prior Publication Data

US 2005/0134417 A1 Jun. 23, 2005

(30) Foreign Application Priority Data

Dec. 17, 2003 (JP) ..... P.2003-419295

(51) Int. Cl.
*H01F 27/02* (2006.01)

(52) U.S. Cl. ..... 336/92; 336/96

(58) Field of Classification Search ..... 336/92, 336/216, 234, 212; 123/635, 634
See application file for complete search history.

(56) References Cited

U.S. PATENT DOCUMENTS 5,225,801 A * 7/1993 Ida et al. ..... 336/96
5,371,486 A * 12/1994 Yamada et al. ..... 336/212

FOREIGN PATENT DOCUMENTS

| | | | | |
|---|---|---|---|---|
| DE | 971 616 C1 | | 2/1959 | |
| DE | 12 73 084 B | | 7/1968 | |
| DE | 21 39 010 A1 | | 3/1973 | |
| DE | 100 14 115 A1 | | 10/2000 | |
| DE | 103 08 077 A1 | | 9/2004 | |
| EP | 0 318 613 A1 | | 6/1989 | |
| JP | 1-86218 | | 6/1989 | |
| JP | 01185908 A | * | 7/1989 | ..... 29/602.1 |
| JP | 3-116704 | | 5/1991 | |
| JP | 6-36950 A | | 2/1994 | |
| JP | 10-294228 | | 4/1998 | |
| JP | 2857890 B2 | | 12/1998 | |

* cited by examiner

*Primary Examiner*—Elvin Enad
(74) *Attorney, Agent, or Firm*—Sughrue Mion, PLLC

(57) ABSTRACT

The ignition coil includes an exciting core having a substantially I-shape, and a closed magnetic path forming core having a substantially C-shape. The ignition coil is constructed in such a manner that first contact faces are formed by a first face of the exciting core and a first face of the closed magnetic path forming core, and a permanent magnet is arranged between these first contact faces, while second contact faces are formed by a second face of the exciting core which is directed to a different direction from the aforesaid first face and a second face of the closed magnetic path forming core which is directed to a different direction from the aforesaid first face.

3 Claims, 5 Drawing Sheets

IGNITION COIL

BACKGROUND OF THE INVENTION

1. Field of the Invention

The present invention relates to an ignition coil which is used mainly in an internal combustion engine for a vehicle.

2. Description of the Related Art

In an ignition coil having an iron core which is provided with a primary coil and a secondary coil wound therearound to form a closed magnetic path, and a permanent magnet which is provided in a part of the iron core, high electric voltage is generated in the secondary coil by supplying a primary current to the primary coil and thereafter cutting it off, thereby to actuate an ignition plug for igniting fuel of the internal combustion engine. Although performance of the ignition coil may depend on specifications of the primary and secondary coils for this purpose, the iron core, permanent magnet, and gaps between them which form the magnetic path have been also significant factors for influencing the performance of the ignition coil. Further, the gaps usually exist at two positions, one at a side where the permanent magnet is provided and the other at an opposite side where the permanent magnet is not provided, and such accuracy as forming no clearance has been required.

[Patent Document 1] Japanese Patent No. 2857890

[Patent document 2] JP-A-6-36950

The invention of Patent Document 1 includes, as shown in FIGS. 6A to 6C, an exciting core 41 for the primary and secondary coils to be wound therearound, a closed magnetic path forming core 42, and a permanent magnet 43. There are formed gaps 44*a*, 44*b* at one position (hereinafter referred to as a first gap) in which the permanent magnet 43 is arranged, and a gap 45 at the other position (hereinafter referred to as a second gap) in which the permanent magnet is not arranged. At least one of the gaps at the two positions is so designed that contact faces of the two iron cores are inclined so as to restrain formation of the gap. Moreover, the closed magnetic path forming core 42 is covered with a covering, and the covering is provided with a projected portion for positioning the permanent magnet 43. Patent Document 2 also discloses such a structure that an exciting core having a substantially T-shape may be internally in contact with a closed magnetic path forming core having a substantially C-shape.

However, in case where the contact faces of the iron cores are inclined, it has been necessary to form the inclined faces not only in the closed magnetic path forming core 42 but also in the exciting core 41, which the primary and secondary coils are wounded so as to be consistent with the inclination of the closed magnetic path forming core 42. In this case, there has been a problem that a clearance may be formed between the contact faces, or only a part of the contact faces may get in contact, which results in disadvantages in workability and production cost. Moreover, there has been a problem that positioning of the permanent magnet has become necessary, because it has been difficult to mount the permanent magnet stably on the inclined faces, or an effective sectional area has been made small due to narrowed tip ends of the inclined iron cores, and magnetic flux density has become poor. In addition, there has been a problem that the first and second gaps cannot be decreased unless dimensional accuracy of the iron cores is controlled, also on occasion of internally contacting the exciting core with the closed magnetic path forming core in a C-shape. In view of the above described circumstances, an object of this invention is to provide such an ignition coil that the gaps can be made narrow at a lower cost.

SUMMARY OF THE INVENTION

According to this invention, there is provide an ignition coil including an exciting core provided with a primary coil and a secondary coil which are wound therearound, a closed magnetic path forming core which is in contact with this exciting core and adapted to pass a magnetic flux generated from the coils, and a permanent magnet provided at a position between the exciting core and the closed magnetic path forming core, characterized in that both the cores have a substantially square shape in cross section, and include at least two contact positions, contact faces of a first contact position being formed by a first face of the exciting core and a first face of the closed magnetic path forming core, contact faces of a second contact position being formed by a second face of the exciting core which is directed to a different direction from the first face and a second face of the closed magnetic path forming core which is directed to a different direction from the first face, and that the permanent magnet is arranged between the contact faces of either one of the contact positions.

According to this invention, because the contact faces of the first contact position are formed by the first face of the exciting core and the first face of the closed magnetic path forming core, and the contact faces of the second contact position are formed by the second face of the exciting core which is directed to a different direction from the first face and the second face of the closed magnetic path forming core which is directed to a different direction from the first face, and the permanent magnet is arranged between the contact faces of either one of the contact positions. Therefore, dimensional accuracy of both the iron cores is not required as in the conventional device, but the gaps at the contact faces can be minimized at a low cost, and as the results, magnetic efficiency can be advantageously enhanced.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Embodiment 1

Figure 1:
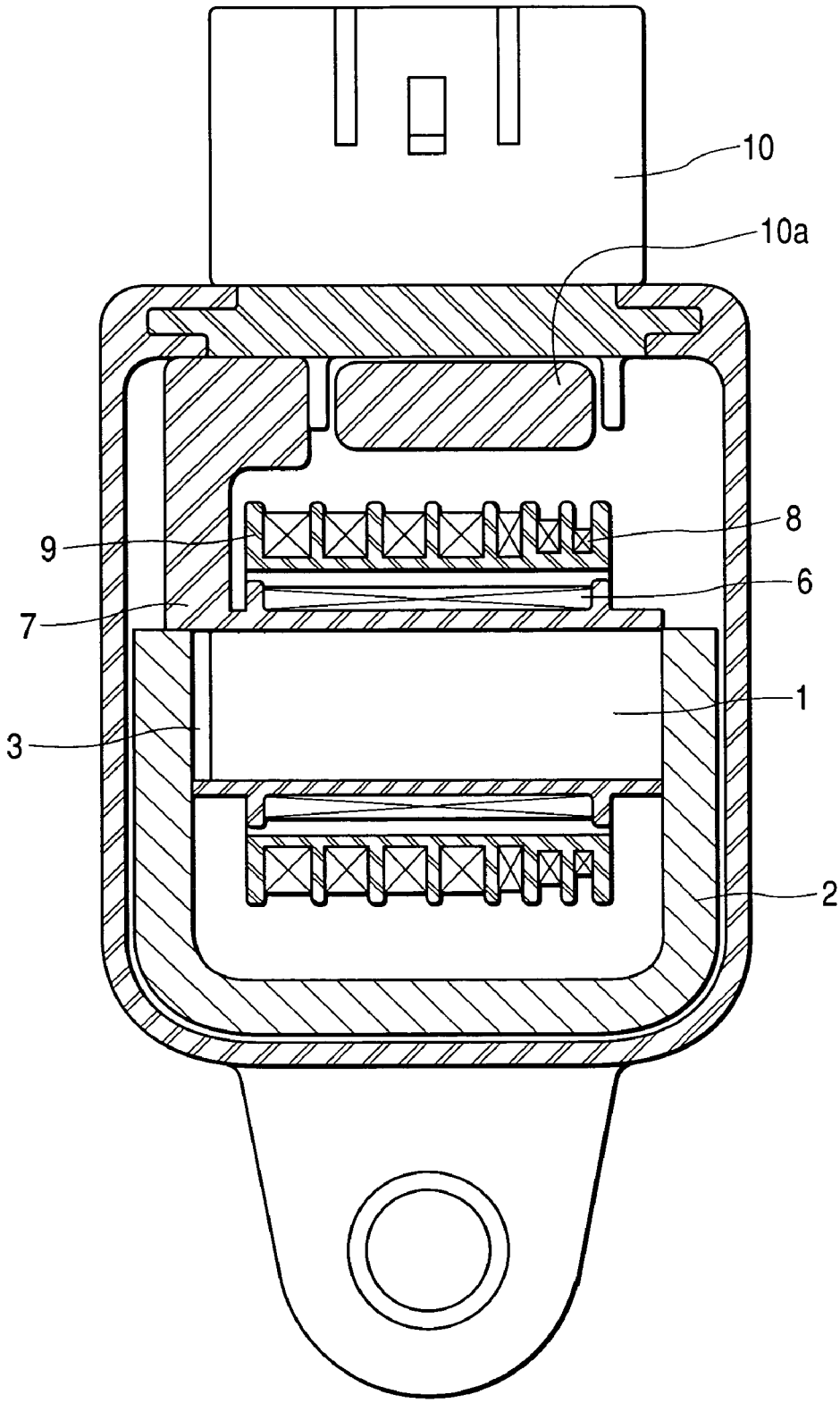
FIG. 1 is a sectional view showing an entire structure of an ignition coil in Embodiment 1 of this invention.

Referring to the drawings, Embodiment 1 of the ignition coil to which this invention is applied will be described. FIG. 1 is a sectional view showing an entire structure of the ignition coil. In FIG. 1, denoted by numeral 1 is an exciting core in a substantially I-shape which is provided, on its outer periphery, with a primary coil 6 wound around a first bobbin 7, and on its still outer periphery, with a secondary coil 8 wound around a second bobbin 9. A closed magnetic path forming core 2 has a substantially C-shape, and is so designed as to enclose therein the aforesaid primary and secondary coils 6, 8 and the exiting core 1. Numeral 3 represents a permanent magnet arranged in a first gap. Numeral 10 represents a connector component including a so-called igniter device 10*a* for switching on and off the electric current passed through the primary coil 6. A part of the first bobbin 7 is protruded so as to be adjacent to the igniter device 10*a* for enabling signals of the connector 10 and the igniter device 10*a* to be connected to the primary coil.

Figure 2A:
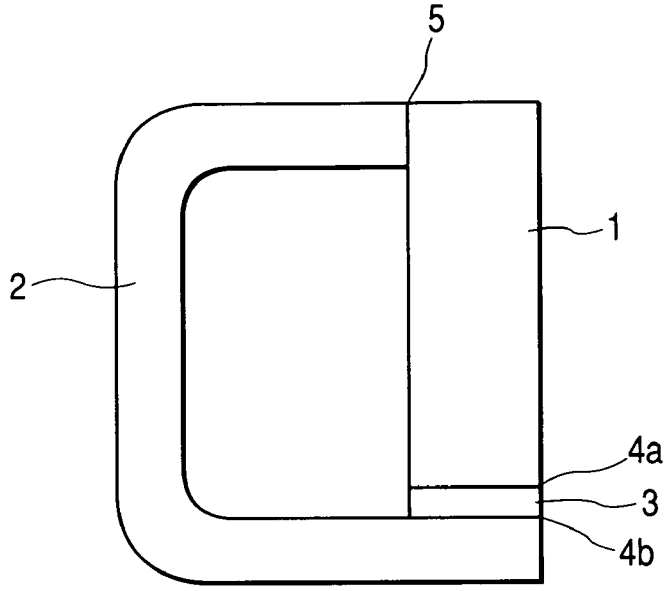
FIGS. 2A and 2B are schematic views showing an essential part of the ignition coil in Embodiment 1.
Figure 2B:
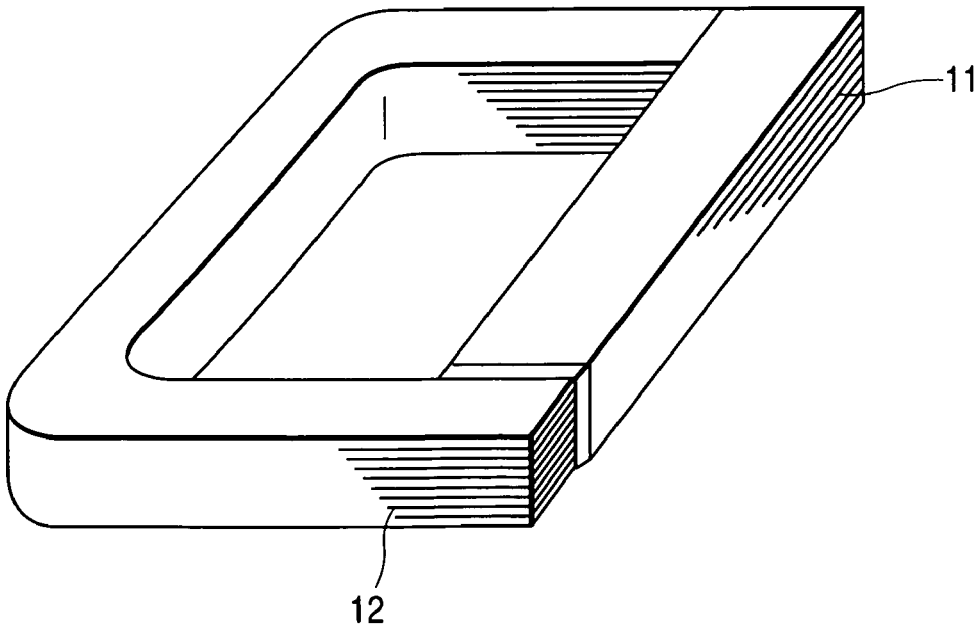

FIGS. 2A and 2B are views showing an essential part only, of which FIG. 2A is a plan view and FIG. 2B is a perspective view. There is shown only an arrangement of the exciting core 1, the closed magnetic path forming core 2, the permanent magnet 3, the first gaps 4*a*, 4*b*, and the second gap 5. Both the iron cores 1, 2 must be manufactured and assembled with a certain degree of accuracy, because they are formed of a number of thin plates 11, 12 (about 0.5 mm) laminated for the purpose of restraining loss of eddy currents. However, the two iron cores 1, 2 are different in shape, and tolerance may occur when these components have been assembled, which will be a cause for a clearance formed between the contact faces. In case where the clearance is formed, the magnetic flux will be decreased and secondary electric voltage will be lowered, because magnetic resistance of air or so is larger than magnetic resistance of the iron cores. For this reason, it is necessary to decrease the gaps to the largest degree. As shown in FIGS. 2A and 2B, the gaps 4, 5 are formed between the exciting core 1 and the closed magnetic path forming core 2. Moreover, the first gap 4 is formed by the permanent magnet 3 at both sides thereof. However, because the two iron cores 1, 2 are attracted by magnetic force of the permanent magnet 3, the first gaps 4*a*, 4*b* will not be a problem, provided that flatness of the contact faces are assured. In other words, how the second gap should be decreased with reference to the first gap is the problem to be solved.

As a first step, the permanent magnet 3 is arranged on a first end face of the exciting core 1 so as to come into contact with a first face of the closed magnetic path forming core 2. Then, a second face of the exciting core 1 which is directed to a different direction from the aforesaid first end face and located remote therefrom is arranged so as to come into contact with a second end face of the closed magnetic path forming core 2 which is directed to a different direction from the aforesaid first face and located remote therefrom. By taking such positional relation, even though the exciting core 1 and the closed magnetic path forming core 2 are different in dimensional accuracy, for example, unless either of length, width, and thickness of the iron cores is within a strict dimensional accuracy, occurrence of the gaps can be restrained, provided that the flatness of the contact end faces only are secured.

More specifically, the first contact face and the second contact face are offset by 90 degree, control of the gaps can be made only by controlling the flatness of the first end face of the exciting core 1 which is adjacent to the gap 4*a*, and the flatness of the first face of the closed magnetic path forming core 2 which is adjacent to the gap 4*b* and the second end face of the iron core 2 which is adjacent to the gap 5. Accordingly, even though the dimensional accuracy of the iron cores in a substantially I-shape and C-shape are not strictly controlled, the gaps of a magnetic circuit can be made small. As the results, it would be advantageously attained that magnetic efficiency can be enhanced, and secondary voltage can be increased.

Figure 3:
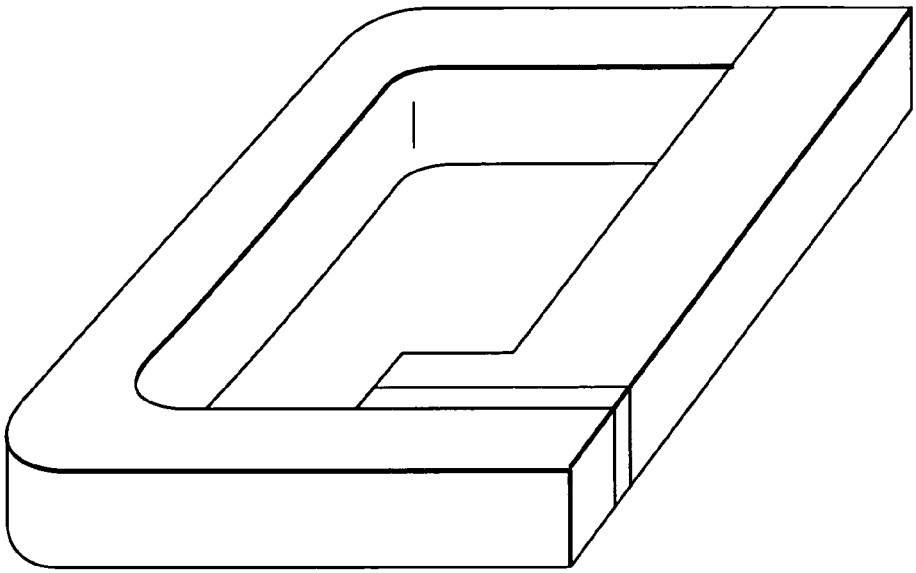
FIG. 3 is a schematic view showing the essential part of the ignition coil in Embodiment 1.

Although direction of laminating the thin plates 11, 12 are the same in both the exciting core and the closed magnetic path forming core in this embodiment, the directions of laminating the thin plates in both the iron cores may be different from each other. Moreover, although the exciting core has been described as having the substantially I-shape, it may have a substantially L-shape by enlarging the part which comes into contact with the permanent magnet, so as to secure the contact area with the permanent magnet. FIG. 3 shows this L-shaped iron core. Although the exciting core and the closed magnetic path forming core have been distinguished from each other for convenience of explanation, they may be exchanged without problem. Explaining specifically referring to FIGS. 2A and 2B, there are two cases of winding the primary and secondary coils, a first case in which the primary and secondary coils are wound so as to extend between the two iron cores and at a left side in FIGS. 2A and 2B of the closed magnetic path forming core 2, and a second case in which the coils are wound so as to extend between the two iron cores and at a right side in FIGS. 2A and 2B of the exciting corel. Either case is possible.

Embodiment 2

Figure 4:
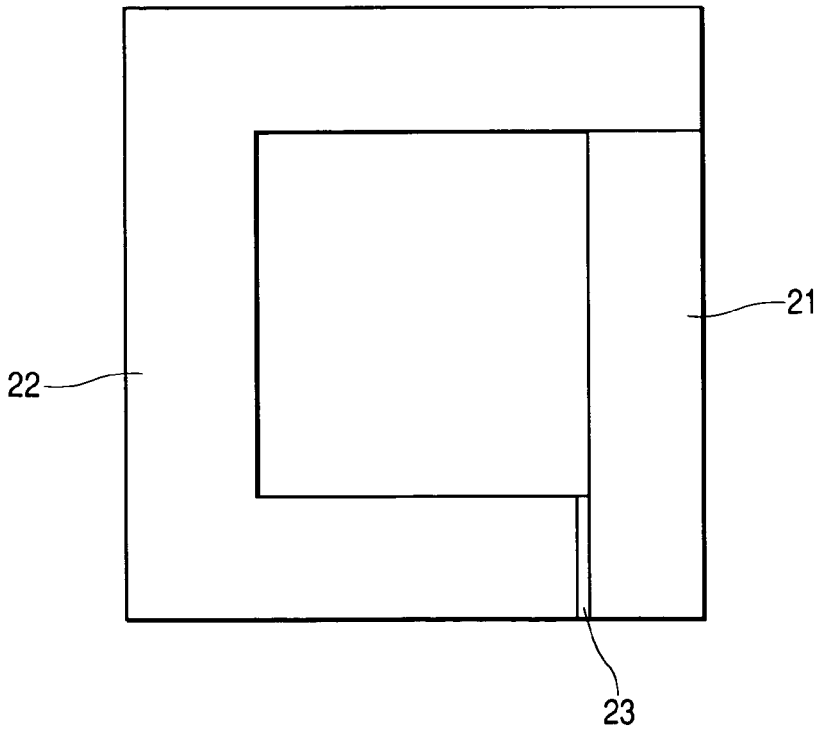
FIG. 4 is a schematic view showing an essential part of the ignition coil in Embodiment 2.

Now, Embodiment 2 will be described referring to FIG. 4. An exciting core 21, a closed magnetic path forming core 22, and a permanent magnet 23 are arranged as shown in FIG. 4. One face in a longitudinal direction of the exciting core 21 is faced with one end face of the closed magnetic path forming core 22, and the permanent magnet 23 is arranged between them. In addition, the other end of the exciting core 21 which is remote from the face adjacent to the permanent magnet 23 is brought into contact with the other face of the closed magnetic path forming core 22 which is remote from the face adjacent to the permanent magnet 23. Even in such positional relation, it is possible to take such a structure such that the gaps may not be affected by variations of the components, by controlling only the flatness of the faces of the two iron cores which are adapted to come into contact.

Embodiment 3

Figure 5:
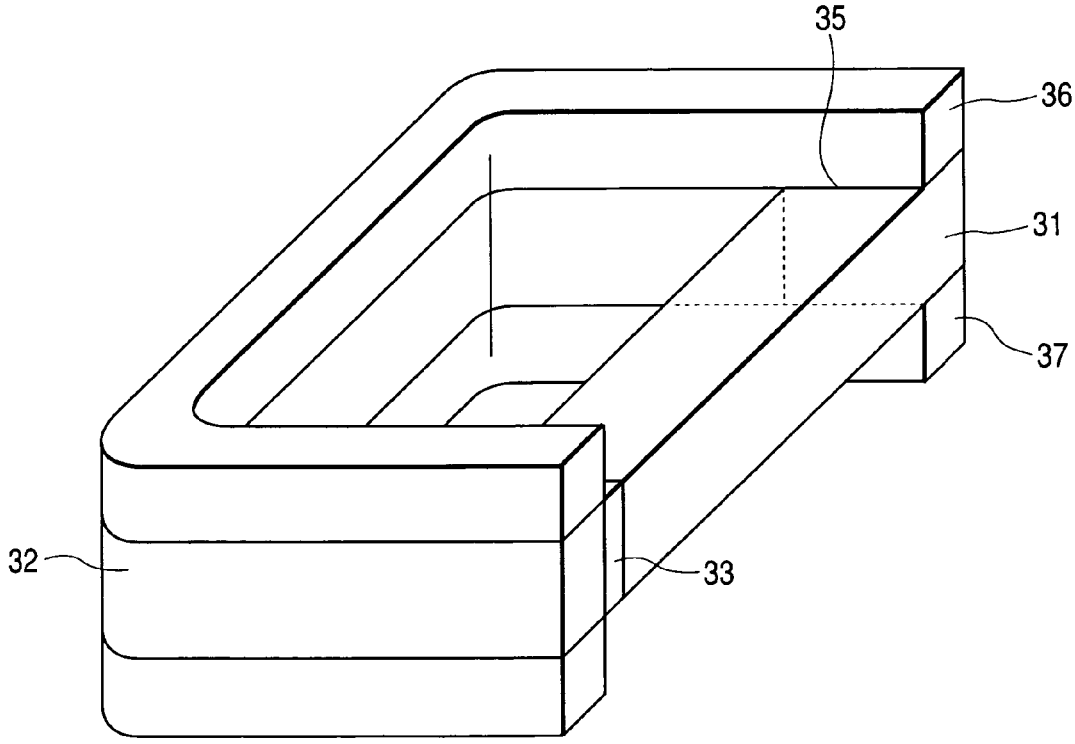
FIG. 5 is a schematic view showing an essential part of the ignition coil in Embodiment 3.
Figure 6A:
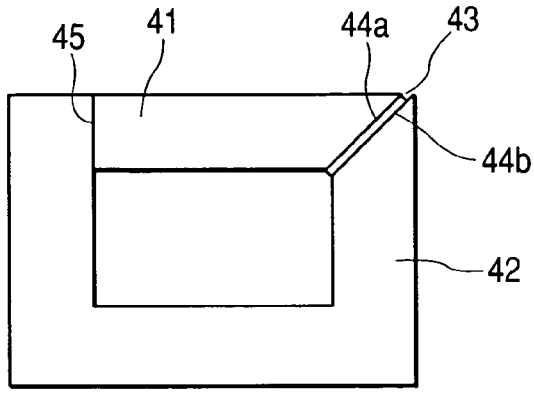
FIGS. 6A to 6C are schematic views showing an essential part of the ignition coil in a conventional device.
Figure 6B:
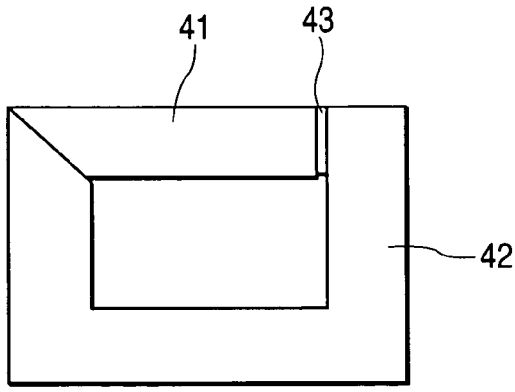
Figure 6C:
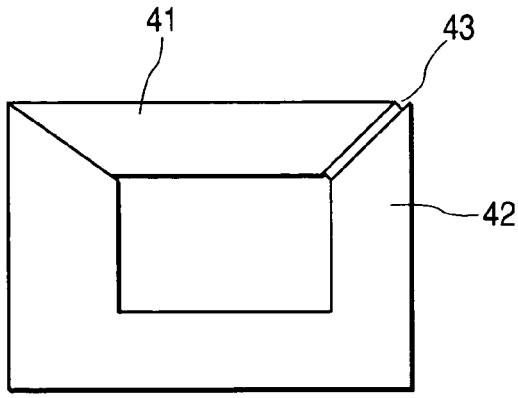

Then, Embodiment 3 will be described referring to FIG. 5. Usually, there is only a small difference in sectional area between the exciting core and the closed magnetic path forming core for the purpose of securing an area for the magnetic path. Accordingly, the sectional areas of the exciting core 11 and the closed magnetic path forming core 12 are close to each other as shown in FIG. 2B. However, provided that the closed magnetic path forming core 12 can obtain same magnetic density as that of the exciting core 11, the cores need not have the same sectional shape. Therefore, in case where a predetermined area is secured as the sectional area of the gaps, the sectional shapes of the iron cores can be optionally changed. In FIG. 5, as compared with the exciting core 31, the closed magnetic path forming cores (32, 36, 37) have an elongated shape. As the results, the faces to be contacted will be limited, and it would be necessary to control the flatness of only the faces to be contacted, but those faces which are not contacted need not be controlled in dimensional accuracy. Particularly, as shown in FIG. 5, a gap 35 which has been newly created can be almost eliminated by taking the same directions for laminating the thin plates, from the below to the above in the drawing, in both the iron cores, provided that only assembling accuracy in laminating process is controlled. Further, the primary and secondary coils are wound around the exciting core 31 in the same manner as shown in FIG. 1. Taking these two coils into consideration, the structure of FIG. 3 has a smaller thickness of the closed magnetic path forming core, when viewed from the above in the drawing, than the structure of FIGS. 2A and 2B, an so, has an advantage that the whole structure can be downsized in view of projective area.

Although the closed magnetic path forming core has a structure formed of three layers (32, 36, 37) in FIG. 5, it may be formed of two layers omitting either one of the iron cores 36 and 37.

This invention can be applied not only to the ignition coil for an internal combustion engine for vehicles, but also to the ignition coils for ships, airplanes and so on.

What is claimed is:

1. An ignition coil comprising:

an exciting core provided with a primary coil and a secondary coil which are wound therearound;

a closed magnetic path forming core which is in contact with this exciting core and adapted to pass a magnetic flux generated from said coils; and a permanent magnet provided at a position between said exciting core and said closed magnetic path forming core, wherein both said cores have a substantially square shape in cross section, and include at least two contact positions, contact faces of a first contact position being formed by a first face of said exciting core and a first face of said closed magnetic path forming core, contact faces of a second contact position being formed by a second face of said exciting core which is directed to a different direction from said first face and a second face of said closed magnetic path forming core which is directed to a different direction from said first face, and that said permanent magnet is arranged between the contact faces of either one of the contact positions, and wherein, both the cores are formed by laminating a plurality of thin plates in a same direction, said closed magnetic path forming core including at least a first closed magnetic path forming core formed of said laminated thin plates which have a first shape and a second closed magnetic path forming core formed of laminated thin plates which have a second shape partly different from the first shape, the contact faces of the first contact position are formed by a first face of the exciting core and a first face of said first closed magnetic path forming core, said permanent magnet being arranged between the contact faces of the first contact position, while the contact faces of the second contact position are formed by a second face of the exciting core and a second face of said first closed magnetic path forming core, and further, a third contact position is formed adjacent to said second contact position between a third face of said exciting core and the first face of said second closed magnetic path forming core.

2. An ignition coil according to claim 1, wherein the contact faces of the first contact position and the second contact position are in such positional relation that they are offset by 90 degree from each other.

3. An ignition coil according to claim 2, wherein the exciting core has a substantially I-shape, and the closed magnetic path forming core has a substantially C-shape.

* * * * *